United States Patent [19]

Swanson

[11] 4,175,571

[45] Nov. 27, 1979

[54] CIGARETTE FILTERS

[75] Inventor: Gerald T. Swanson, Fort Collins, Colo.

[73] Assignee: Teledyne Industries, Inc., Ft. Collins, Colo.

[21] Appl. No.: 828,505

[22] Filed: Aug. 29, 1977

[51] Int. Cl.[2] ..... A24D 1/04; A24F 7/02; A24F 7/04

[52] U.S. Cl. ..... 131/171 A; 131/198 R

[58] Field of Search ..... 131/202, 10, 17 R, 171 A, 131/261 B, 187, 198 R, 261, 198 A, 210, 216

[56] References Cited

U.S. PATENT DOCUMENTS

| | | | |
|---|---|---|---|
| 3,713,452 | 1/1973 | D'Elia | 131/198 A |
| 4,038,994 | 8/1977 | Aikman | 131/187 |
| 4,049,005 | 9/1977 | Hernandez et al. | 131/198 A |

*Primary Examiner*—V. Millin

*Attorney, Agent, or Firm*—Hugh H. Drake

[57] ABSTRACT

A cigarette filter includes a barrel, a mouthpiece at one end and a cigarette-receptive tip at the other. A restricted orifice extends through a transverse wall within the barrel. An air inlet extends through the barrel wall at a location toward the mouthpiece from the transverse wall. Received within the barrel is a stem that defines a passage for the flow of smoke, and the inlet also communicates with that passage. The stem includes a nose which is spaced from the outlet end of the orifice and defines a collection area for particulate matter included in the smoke. A system concept includes a combination of a plurality of such filters in each successive one of which the orifice is of respectively decreased diameter and the air inlet is of respectively increased diameter. The relationship of those diameters is such that different ones of the filters establish a substantially constant impedance to the drawing of smoke and air through the mouthpiece.

2 Claims, 11 Drawing Figures

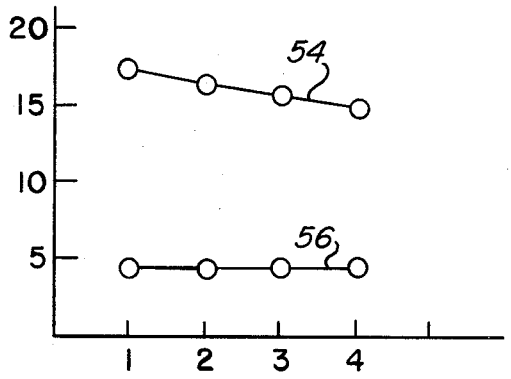
Fig-7
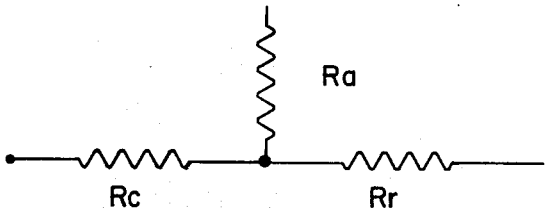
Fig-8
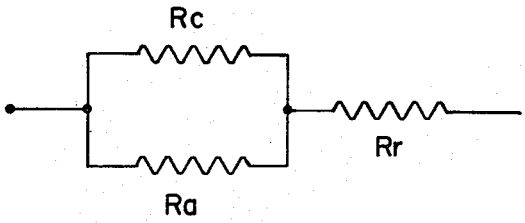
Fig-9
Fig-10
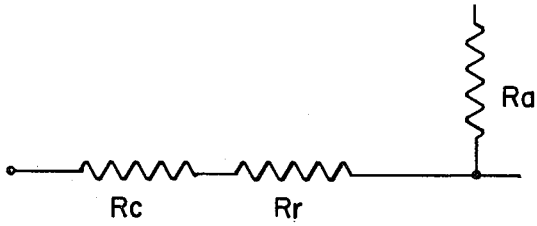
Fig-11
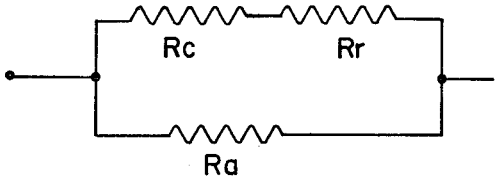

CIGARETTE FILTERS

The present invention relates to cigarette filters. It also pertains to a system utilizing such filters.

It has long been recognized that the smoking of cigarettes may be detrimental to one's health. Most generally, it is stated that particulate matter within the cigarette smoke, such as nicotine and tars, is undesirably inhaled into the human system. Over the years, an enormously large variety of filters have been suggested for processing the smoke prior to inhalation and thereby removing such particulate matter.

Usually, such filters either interpose a finely-meshed material in the path of the smoke or create a tortuous route for the passage of the smoke so as to cause the settling out of particulate matter on surfaces presented within the filter. Typical of the latter approach are the disclosures in U.S. Pat. Nos. 3,519,000—Houser, 3,577,995—White, 3,361,866—Bottazzi, 3,810,476—Thomas, 3,402,724—Blount et al, 3,636,960—Blount et al, 3,472,238—Blount et al, 3,174,487—Missler and 3,926,199—Thomas.

In one approach suggested in several of the aforementioned patents, a quantity of air is admitted into the smoke passage so as to dilute the smoke ultimately inhaled. Also suggested is the provision of a plurality of similar filters differing one from the next in the amount of air which is inletted to the smoke passage. The concept involves assisting a smoker in withdrawal by his use, over a period of time, of successive different ones of such filters so as gradually to reduce the concentration of the smoke at the mouthpiece. One difficulty with that approach is that the user experiences a reduction in the amount of withdrawal force or drag required as filters are used which allow the inlet of an increased amount of air. This may be an at least psychological detriment to complete success in using such a system.

It is, accordingly, a general object of the present invention to provide a new and improved withdrawal system which at least substantially equalizes the drawing force required of successively-used different filters which correspondingly increase the dilution of the inhaled smoke.

Another object of the present invention is to provide a new and improved cigarette filter in which the impedance to the drawing of smoke therethrough is substantially reduced while yet effectively removing particulate matter.

A further object of the present invention is to provide a new and improved cigarette filter in which all critically-sized elements are provided in the same part.

The invention is embodied in a cigarette filter which includes a barrel, a mouthpiece coupled at one end of the barrel and a tubular cigarette-receptive tip coupled at the other end. A transverse wall located internally of the barrel adjacent to the tip includes a restricted orifice. An air inlet is defined through the wall of the barrel at a location opposite the tip from the transverse wall. A stem received within the barrel defines a passage for the flow of smoke and the air inlet also communicates with that passage. The stem includes a nose which faces but is spaced from the outlet end of the orifice and defines a collection area for particulate matter included in the smoke. From a system standpoint, there are a plurality of filters in which each successive one has an orifice of respectively decreased diameter and an inlet of respectively increased diameter with the relationship of those diameters as between different ones of the filters being such as to establish a substantially constant impedance to the drawing of fluid through the corresponding mouthpieces.

The features of the present invention which are believed to be novel are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

FIG. 7 is a graph depicting performance characteristics of cigarette filters;

FIG. 8 is a schematic diagram illustrating impedance relationships involved in cigarette filters of prior designs;

FIG. 9 is a schematic diagram depicting an equivalent to that of FIG. 8;

FIG. 10 is a schematic diagram representing impedance relationships pertaining to the embodiment of the present invention; and FIG. 11 is another schematic diagram which represents an impedance circuit equivalent to that shown in FIG. 10.

Figure 1:
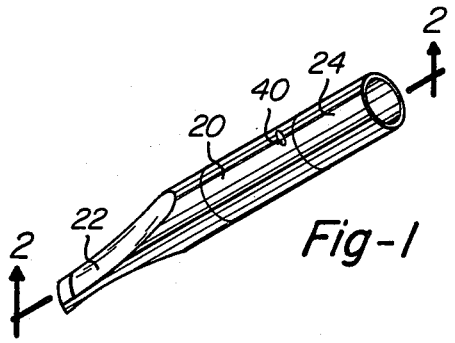
FIG. 1 is a perspective view of a cigarette filter constructed in accordance with one embodiment.
Figure 2:
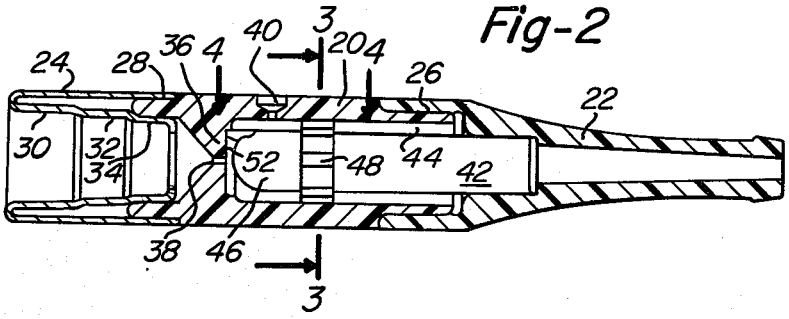
FIG. 2 is a cross-sectional view taken along the line 2—2 in FIG. 1.
Figure 3:
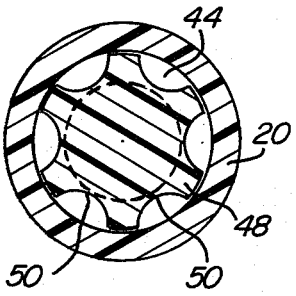
FIG. 3 is a cross-sectional view taken along the line 3—3 in FIG. 2.
Figure 4:
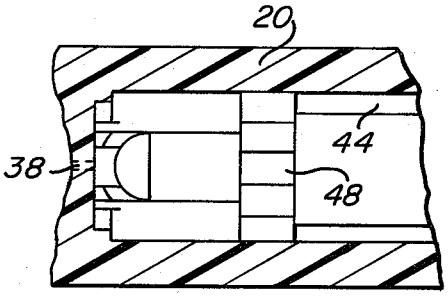
FIG. 4 is a cross-sectional view taken along the line 4—4 in FIG. 2.

As herein embodied, a cigarette filter includes a barrel 20, a mouthpiece 22 and a tip 24. Mouthpiece 22 is frictionally engaged upon a necked-down portion 26 at one end of barrel 20, and an also necked-downed portion 28 at the other end of barrel 20 receives tip 24. Interiorly, tip 24 includes a progressive succession of internal bosses 30, 32 and 34 sized to receive respective different commonly-available diameters of cigarettes.

Located interiorly of barrel 20 is a transverse wall 36 adjacent to tip 24. An orifice 38 is defined centrally through wall 36. An air inlet 40 is defined through the wall of barrel 20 at a location opposite tip 24 from wall 36.

A cylindrical stem 42, of a diameter less than that of the interior of barrel 20, is received within the barrel and defines a passage 44 for the flow of smoke from tip 24 through orifice 38 to mouthpiece 22. Inlet 40 also communicates with passage 44 so as to enable the flow of air therethrough to mouthpiece 22 in mixture with smoke drawn from tip 24. Stem 42 includes a nose 46 that faces but is spaced from the outlet end of orifice 38. Nose 46 defines a collection area for particulate matter included in the smoke. Mounting stem 42 within barrel 20 is a ring 48 which circumscribes the stem and has a plurality of circumferentially-spaced flutes 50 that not only present outer ends to mount the stem within the barrel but also constitute a portion of passage 44. Ring 48 is located downstream of inlet 40. Formed into the surface of transverse wall 36 opposite tip 24 is a recess 52 into which nose 46 projects.

In use, a cigarette is inserted into an appropriate one of bosses 30–34. The user sucks through mouthpiece 22 so as to cause smoke from the cigarette to flow through orifice 38, around nose 46, through the fluting in ring 48 and on down passageway 44 to the mouthpiece. At the same time, the smoke from the cigarette is diluted by air drawn through inlet 40 by Venturi effect.

By itself, the described filter is advantageous in that both orifice 38 and inlet 40, which desirably are critically dimensioned, are formed in the same part. There is no critical spacing with regard to the other components except insofar as frictional interengaging relationships are maintained. In particular, the spacing of the front-end of nose 46 from transverse wall 36 and orifice 38 is entirely uncritical to satisfactory operation of the unit. This contrasts with prior devices, including some of those mentioned in the introduction, wherein a rigorous spacing tolerance had to be maintained in order to achieve adequate disposition of particulate matter from the smoke.

Figure 5:
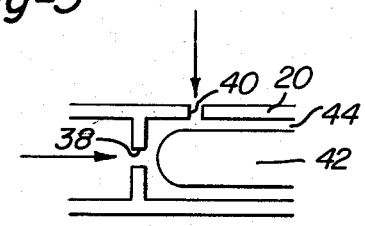
FIG. 5 is a schematic diagram illustrating one relationship of parts included within the embodiment of the preceding figures.
Figure 6:
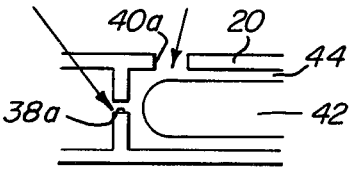
FIG. 6 is a schematic view similar to FIG. 5 but illustrating a different relationship of such parts.

Filters of this general type find advantageous use in systems designed to aid a user in the withdrawal from smoking. As mentioned in the introduction, a succession of different ones of otherwise like filters may include respectively different sizes of air inlet openings as correspondingly illustrated in FIGS. 5 and 6 for openings 40 and 40*a*. With a progressive increase in the diameter of inlet 40 or 40*a*, however, the draw resistance or impedance at the outlet of mouthpiece 22 is steadily decreased as exhibited by curve 54 of FIG. 7 which plots such resistance on an arbitrarily enumerated vertical scale as against a horizontal enumeration which represents a succession of four different and successfully increased sizes of aperture 40 (or 40*a*). In the present embodiment, on the other hand, and as may be seen upon a comparison of FIGS. 5 and 6, successive different ones of the filters employ corresponding apertures 38 and 38*a* of difference in diameter such that, as each air inlet 40 and 40*a* is increased in diameter, the corresponding orifice 38 and 38*a* is of decreased diameter. In this manner, the relationship of the respective diameters as between the air inlets and the orifices is such as to establish a substantially constant impedance to the drawing of the mixture of air and smoke through the mouthpieces even though the filters are changed to increase dilution. Thus, the flow impedance established by successive different ones of the filters is represented by curve 56 in FIG. 7.

The approaches of the prior art have traditionally located any air inlet in advance of an orifice which restricts flow passage, such as orifice 38. The impedance relationships of that kind of arrangement are indicated in FIG. 8, wherein Ra is the impedance presented by the air inlet, Rc is the impedance presented by the cigarette itself and Rr is the resistance of the internal orifice. As seen from the equivalent circuit of FIG. 9, there is some reduction of total impedance by means of the effective paralleling of Rc and Ra, but that total is always added in series with the impedance presented by the internal orifice. Thus, the necessary inclusion of the central orifice for the purpose of achieving filtering action always increases total draw resistance. In itself, that tends to render the use of the filter somewhat unacceptable to some users.

The arrangement of the present filter is different. The resultant impedance diagram is shown in FIG. 10 wherein the cigarette impedance Rc is in series with the impedance Rr of orifice 38, while the impedance Ra of air inlet 40 is in shunt at the end of that series combination. The equivalent impedance circuit of the overall new arrangement is shown in FIG. 11. It will be observed that this network involves a paralleling of the air inlet impedance with that of the series combination of the cigarette and the orifice. It then will also be observed that the air inlet impedance is thereby combined with the series impedance of the combination of the cigarette and the orifice in a manner such that the effect of the air inlet impedance is substantially lowered as contrasted with the arrangement of FIGS. 8 and 9 wherein the impedance of the orifice always remains in a series additive relationship. The result of putting the orifice impedance into a parallel combination is to reduce its effective value as contrasted with those filter approaches which employ an air inlet ahead of the restrictive orifice. In terms of the user, that means less draw resistance imposed by employment of the filter. In turn, that increases the likelihood that the user will be content to employ the filter.

As may be seen by comparison, the filter of the present embodiment is in itself not particularly either more simple nor more complex than those typical of the prior art. At the same time, there is a specifically different interrelationship of various parts which leads to decreased draw impedance as well to the enablement of a withdrawal system, composed of a plurality of filters, wherein draw impedance may be maintained relatively constant as air mixture is varied between one filter and the next.

Further to the system aspects, the draw impedance can be maintained at a desirable low level while, through reciprocal adjustment of the sizes of apertures 38 and 40, the reduction of smoke constituents can be independently and successively varied over a range from zero to a very high percentage. The particular parallel resistance configuration of the present arrangement yields unique performance characteristics. Moreover, it is to be noted that the amount of tar and nicotine collected or trapped within the filters can be varied independently of the draw impedance as can be the percentage reduction of tar and nicotine yielded to the smoker. Thus, the filters in the system may be designed either to collect equal amounts of particulate matter or to collect increasing amounts from one filter to the next. In any case, the change in the relative sizes of apertures 38 and 40 requires a modification of only barrel 20. Tip 24, mouthpiece 22 and stem 42 may remain the same. If desired, only barrel 20 need be changed where varying filter characteristic as the system aspect is followed.

As in the prior art, the walls of barrel 20 desirably are transparent so that the user may visibly observe the amount of matter collected within the filter and thus not inhaled. Another feature is that the disclosed construction is rather entirely symmetrical so that the performance of the filter is not sensitive to its relative orientation. Such a symmetrical approach to construction also tends to avoid the buildup of deposit of particulate matter in any localized area. Stem 42 may be readily removed for cleaning.

While a particular embodiment of the present invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. In a system for progressively withdrawing from smoking and which has a plurality of cigarette filters each of which includes:

a barrel, a mouthpiece coupled to one end of said barrel and a tubular cigarette-receptive tip coupled to the other end of said barrel, including an improvement in each filter which comprises:

a transverse wall located internally of said barrel adjacent to said tip;

means defining a restricted orifice through said wall;

means defining an air inlet through the wall of said barrel at a location downstream from said transverse wall;

a stem received within said barrel and defining a passage for the flow of smoke from said tip through said orifice to said mouthpiece with said inlet also communicating to said passage for the flow of air through said inlet to said mouthpiece in mixture with said smoke, said stem including a nose facing but spaced from the outlet end of said orifice and defining a collection area for particulate matter included in said smoke;

and means for mounting said stem within said barrel;

and the further improvement in which each successive different one of said filters has an orifice of respectively decreased diameter and an inlet of respectively increased diameter, the relationship of said diameters as between the different ones of said filters establishing a substantially constant impedance to the drawing of fluid through the corresponding mouthpiece.

2. In a system for progressively withdrawing from smoking, a plurality of cigarette filters each of which includes a barrel, a mouthpiece coupled to one end of said barrel, a cigarette-receptive tip coupled to the other end of said barrel, a transverse wall intermediate said tip and said mouthpiece, means defining a restricted orifice through said wall, means defining an air inlet through the wall of said barrel downstream of said traverse wall, a stem received within said barrel and defining a passage for the flow of smoke from said tip through said orifice to said mouthpiece and with said inlet communicating air into said passage, and said stem contributing to the collection of particulate matter included in said smoke, the improvement in which each successive different one of said filters has an orifice of respectively decreased diameter and an inlet of respectively increased diameter, the relationship of said diameters as between different ones of said filters establishing a substantially constant impedance to the drawing of fluid through the corresponding mouthpiece.

* * * * *